US005491960A

United States Patent [19]

Taylor, Jr.

[11] Patent Number: 5,491,960

[45] Date of Patent: Feb. 20, 1996

[54] APPARATUS FOR THE CONTINUOUS PRODUCTION OF A PARTICULATE FILLED BARRIER

[75] Inventor: Edgar J. Taylor, Jr., Anderson, Calif.

[73] Assignee: M-B-W Inc., Slinger, Wis.

[21] Appl. No.: 313,920

[22] Filed: Sep. 28, 1994

[51] Int. Cl.[6] ..... B65B 9/06

[52] U.S. Cl. ..... 53/568; 53/391; 53/545

[58] Field of Search ..... 53/550, 568, 450, 53/391, 545, 466, 567; 405/267, 270

[56] References Cited

U.S. PATENT DOCUMENTS

| | | | |
|---|---|---|---|
| 2,883,813 | 3/1955 | Shannon | 53/545 |
| 3,568,453 | 3/1971 | Ziegenmeyer . | |
| 3,807,125 | 4/1974 | Enrich | 53/450 |
| 3,996,721 | 12/1976 | Mercer | 53/450 |
| 4,480,943 | 11/1984 | Leuenberger | 405/172 |
| 4,518,507 | 5/1985 | Conner | 210/747 |
| 4,611,642 | 9/1986 | Durham | 141/114 |
| 4,668,123 | 5/1987 | Larsen | 405/15 |
| 4,672,794 | 6/1987 | Good | 53/567 |
| 4,705,427 | 11/1987 | Atkins et al. | 405/36 |
| 4,799,821 | 1/1989 | Brodersen | 405/115 |
| 4,824,285 | 4/1989 | Trierweiler | 405/17 |
| 5,030,031 | 7/1991 | Brown | 405/36 |

*Primary Examiner*—Lowell A. Larson

*Assistant Examiner*—Gene L. Kim

*Attorney, Agent, or Firm*—Andrus, Sceales, Starke & Sawall

[57] ABSTRACT

An apparatus for continuously producing a particulate filled bag or barrier. The apparatus includes a frame having terrain engaging members, such as runners. A wound coil of sheet material is mounted on the forward end of the frame, and located to the rear of the coil is an open bottom hopper that contains a particulate material, such as sand or gravel. The sides of the hopper are composed of spaced double walls and the rear surface of the hopper is formed with an outlet. The sheet material is unwound from the coil and continuously folded into a generally U-shape by a pair of lower rollers and two pair of upper rollers, which are mounted on the frame forwardly of the hopper. The bottom surface of the folded sheet extends across the open bottom of the hopper, so that the particulate material will be in direct contact with the bottom surface, while the side surfaces of the folded sheet extend upwardly in the spaces between the double side walls of the hopper. The weight of the particulate material resting on the bottom surface of the folded sheet will hold the sheet against the terrain as the frame is moved forwardly, and the folded sheet containing the particulate material is discharged from the outlet in the hopper and passes between a pair of converging side members to compress the particulate material. The upper edges of the side surfaces of the folded sheet are then brought together and connected to provide a bag containing the particulate material.

30 Claims, 4 Drawing Sheets

FIG. 4
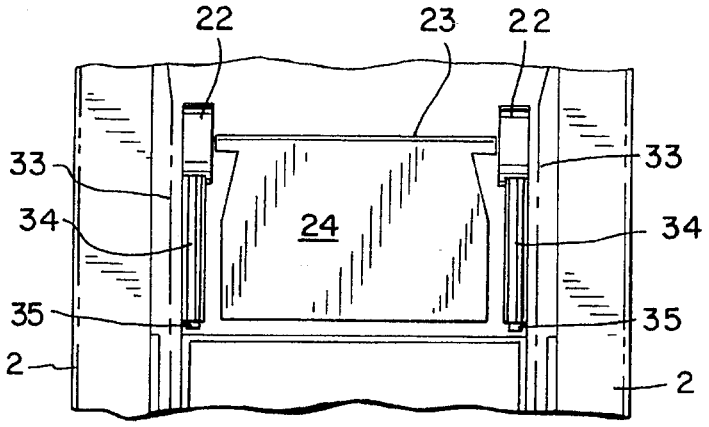
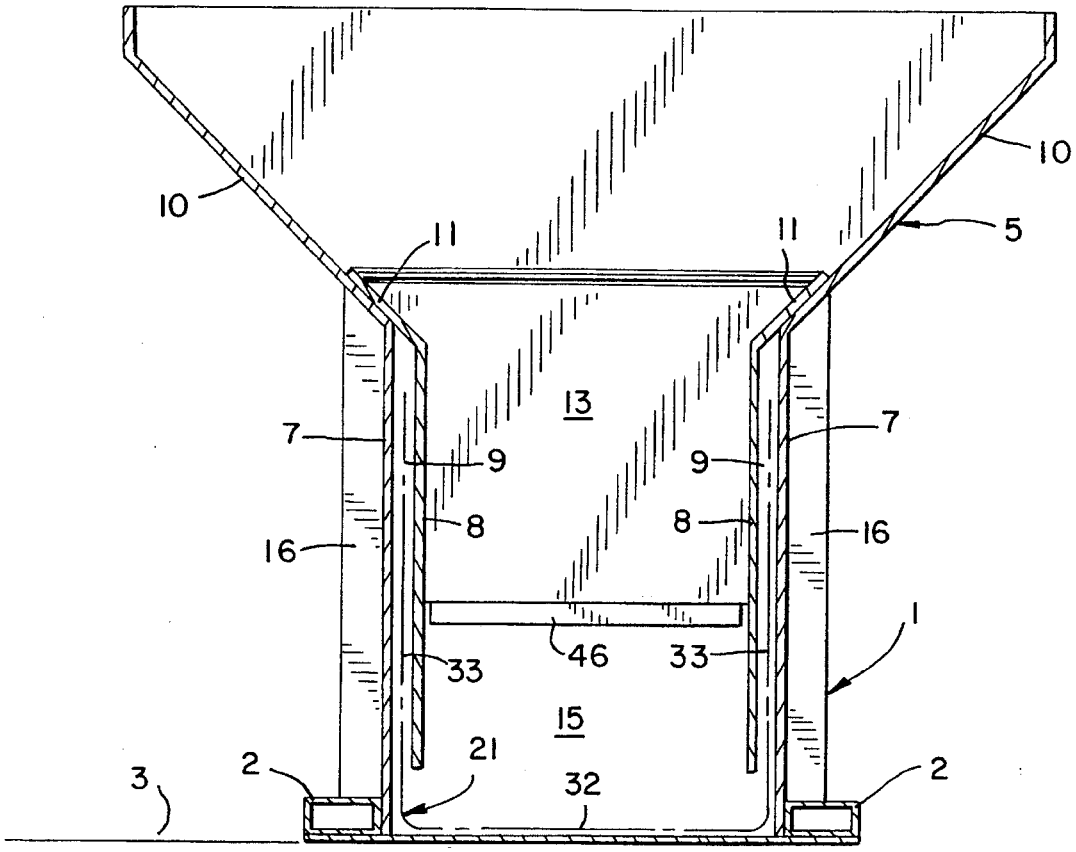
FIG. 5

APPARATUS FOR THE CONTINUOUS PRODUCTION OF A PARTICULATE FILLED BARRIER

BACKGROUND OF THE INVENTION

Sandbags are frequently used as a barrier for flood and erosion control. The use of sandbags is highly labor intensive, as the bags are normally filled manually with sand and then carried and placed in the desired location. There has been a need for a mechanism that would continuously form a sand or particulate filled bag for use as a barrier in flood or erosion control, or for other uses which require a divider wall or barrier.

SUMMARY OF THE INVENTION

The invention is directed to an apparatus for continuously producing a particulate filled bag which can be used as a barrier or berm.

In accordance with the invention, the apparatus comprises a frame that includes terrain engaging members, such as runners, which move across the terrain as the frame is pulled forwardly by a vehicle or other drive source.

A wound coil of sheet material, such as fabric or plastic, is mounted on the forward end of the frame, and located to the rear of the coil is an open bottom hopper that contains a particulate material, such as sand, gravel, stone, or the like. The sides of the hopper are composed of spaced double walls, and the lower portion of the rear wall of the hopper has an outlet.

The flexible sheet is unwound from the coil and is folded into a generally U-shaped configuration by a pair of spaced lower rollers and two pair of upper rollers. The lower rollers are mounted in spaced relation above the runners and engage the bottom surface of the folded U-shaped sheet, while the upper edge of each side surface of the folded sheet passes between a pair of cooperating upper rollers.

The folded sheet extends through the hopper with the bottom surface of the folded sheet extending across the open bottom of the hopper and the side surfaces of the folded sheet being located in the spaces between the double side walls of the hopper. With this construction, the weight of the particulate material in the hopper rests on the bottom surface of the folded sheet to hold the folded sheet against the terrain, while the side surfaces of the folded sheet are out of contact with the particulate material, so that the weight of the particulate material will not tend to draw the side surfaces downwardly.

Two pair of rollers are located at the rear of the hopper and engage the respective upper portions of the side surfaces of the folded sheet. The axes of the rollers at the rear end of the hopper, as well as the axes of the rollers located at the forward end of the hopper are inclined with respect to the vertical, to thereby apply upward tension to the side surfaces of the folded sheet to maintain the side surfaces in a taut condition.

As the frame is moved forwardly by the drive mechanism, the folded sheet containing the particulate material is continuously discharged from the outlet in the hopper and passes between a pair of converging side walls to compress the particulate material. In addition, a downwardly inclined compression plate projects rearwardly from the hopper above the outlet and also serves to compress the particulate material within the folded sheet. After passing between the converging side walls, the upper edges of the side surfaces of the folded sheet are brought together by passing the side edges between a pair of cooperating rolls, and the contiguous side edges can then be attached together by any convenient mechanism, such as hog-ringing, stitching, or the like, to provide a particulate filled bag or barrier.

The apparatus provides an inexpensive and rapid method of forming a particulate filled barrier which substantially reduces the labor costs as compared with conventional methods of forming a particulate filled bag.

The particulate filled bag can be used as a barrier or berm for flood or erosion control, or can be used as a divider in agricultural fields. In addition, the bag can be utilized as a traffic control medium, and in this case traffic control signs can be inserted directly into the bag. The bag can also be employed for containing oil spills on water and in this usage, the particulate material can be a buoyant material, such as plastic spheres or bubbles, or particles of wood, so that the bag will float.

Other objects and advantages will appear in the course of the following description.

DESCRIPTION OF THE DRAWINGS

The drawings illustrate the best mode presently contemplated of carrying out the invention.

In the drawings:

FIG. 4 is a transverse section taken along line 4—4 of FIG. 3;

FIG. 5 is a section taken along line 5—5 of FIG. 2;

DESCRIPTION OF THE ILLUSTRATED EMBODIMENT

Figure 1:
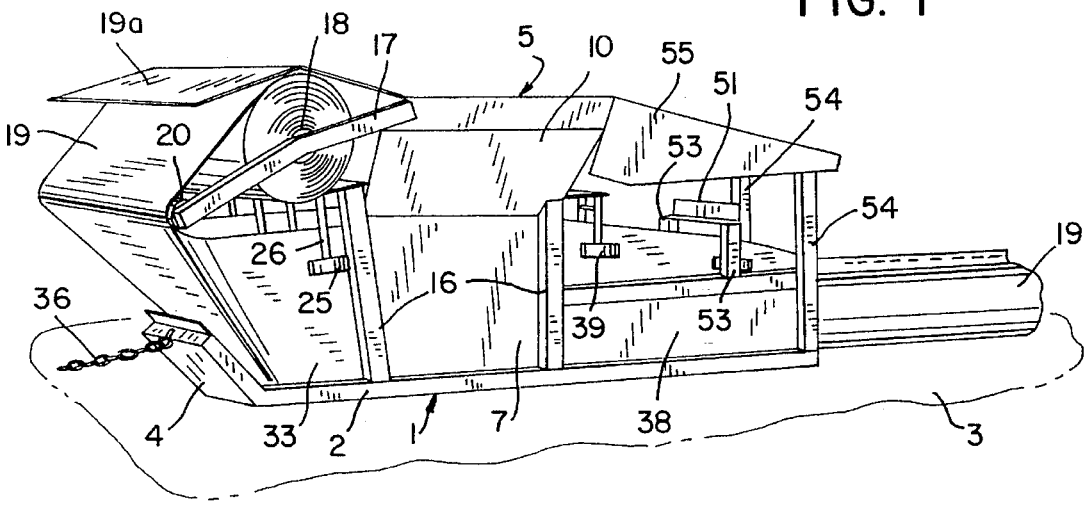
FIG. 1 is a perspective view of the apparatus for producing the particulate filled bag.

The drawings illustrate an apparatus for the continuous production of a particulate filled bag or barrier. The apparatus includes a structural frame 1 having a pair of spaced runners 2 which extend longitudinally of the frame and are adapted to move over the terrain 3. The forward ends of runners 2 are inclined upwardly, and joined together, as indicated by 4.

Mounted generally centrally on frame 1 is a hopper 5 that is adapted to contain a particulate material 6, such as sand, gravel, stones, wood chips, nut shells, or the like. Hopper 5 has an open bottom which communicates through the space between runners 2 with the terrain 3. Hopper 5 also is formed with a pair of parallel sides, each having a double wall construction composed of an outer side wall 7 and an inner side wall 8, which is spaced from the respective outer wall 7 to provide a space 9 therebetween. As best shown in FIG. 5, the upper ends 10 of outer side walls 7 are flared outwardly and the upper ends 11 of the inner side wall members 8 are also flared outwardly and are connected to the flared ends 10 of side wall 7 by welding or the like.

Figure 2:
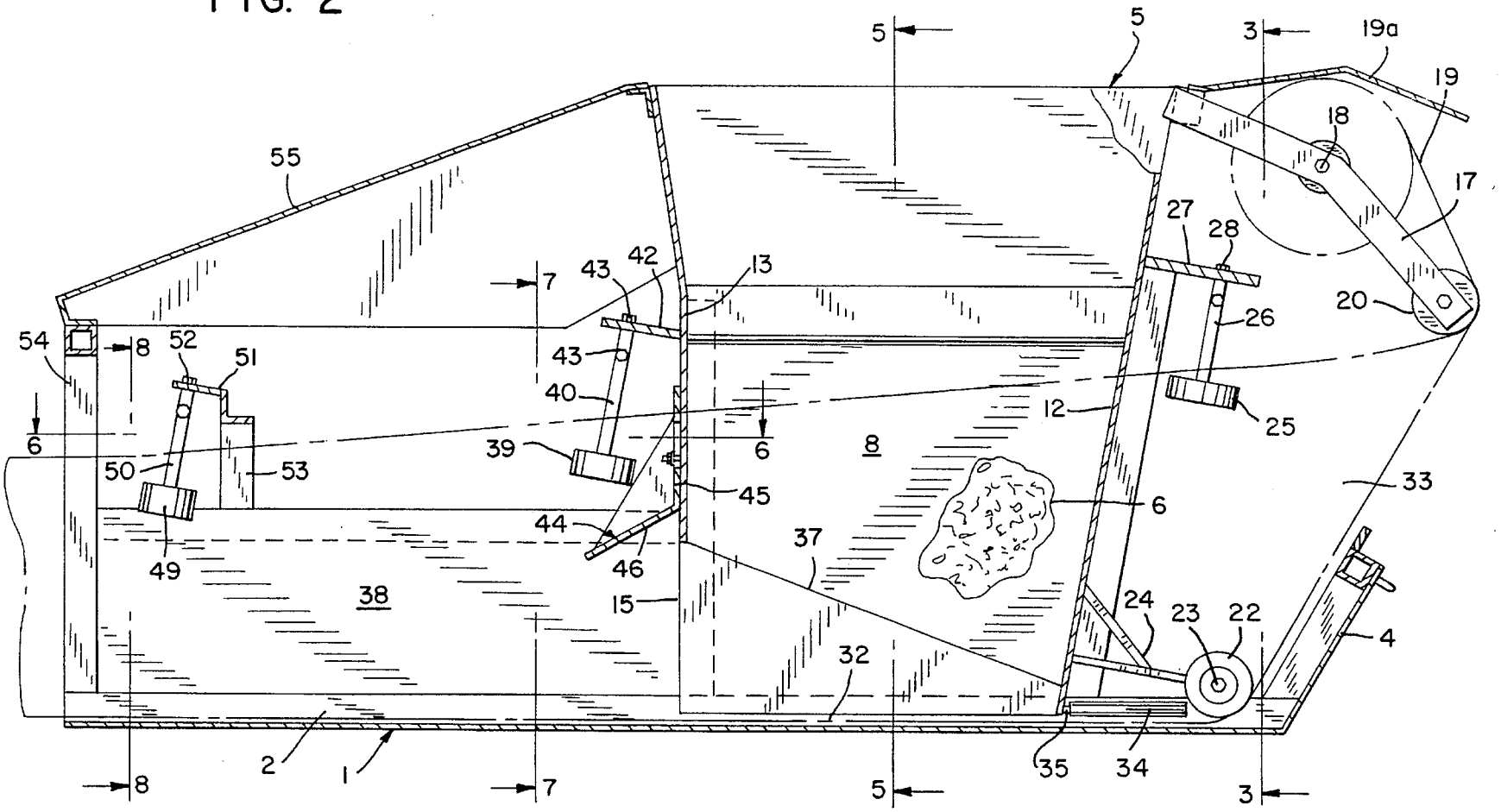
FIG. 2 is a longitudinal section of the apparatus.

Hopper 5 also includes a front wall 12 which connects the front edges of inner side walls 8 and a rear wall 13, which connects the rear edges of walls 8. As shown in FIG. 2, the lower edge of rear wall 13 terminates a substantial distance above runners 2 to provide an outlet 15 in the lower rear portion of hopper 5.

As seen in FIG. 2, a plurality of vertical columns 16 extend upwardly from runners 2 and are secured to the outer surface of the outer side wall 7 to provide reinforcement for the hopper.

A pair of arms 17 extend forwardly from hopper 5 and a shaft 18 is journaled on arms 7. A sheet 19 of flexible material is wound on shaft 18. The sheet 19 can be either a porous or non-porous material and can take the form of fabric or plastic sheeting. A cover 19*a* is hinged to the forward edge of hopper 5 and rests on the coiled sheet 19 to provide tension on the sheet and prevent free unwinding.

As shown in FIG. 2, the free end of sheet 19 passes over a support roller 20 that is journalled on the outer ends of arms 17 and the sheet is then formed or folded into a generally U-shaped configuration indicated by 21. To fold the sheet, a pair of lower rollers 22 are mounted on a horizontal shaft 23 that is secured to a bracket or weldment 24 that projects forwardly from the lower end of hopper 5. Rollers 22 are spaced apart laterally and serve to define the bottom surface of the folded sheet 21.

In addition to rollers 22, the folding of sheet 19 is also accomplished by two pair of upper idler rollers 25, which are located above rollers 22. Each roller 25 is journaled on the end of a shaft 26 and the shafts are supported from a plate 27 that extends forwardly from the front wall 12 of hopper 5. Nuts 28 are threaded on the upper ends of shafts 26 to attach the shafts to plate 27.

Figure 3:
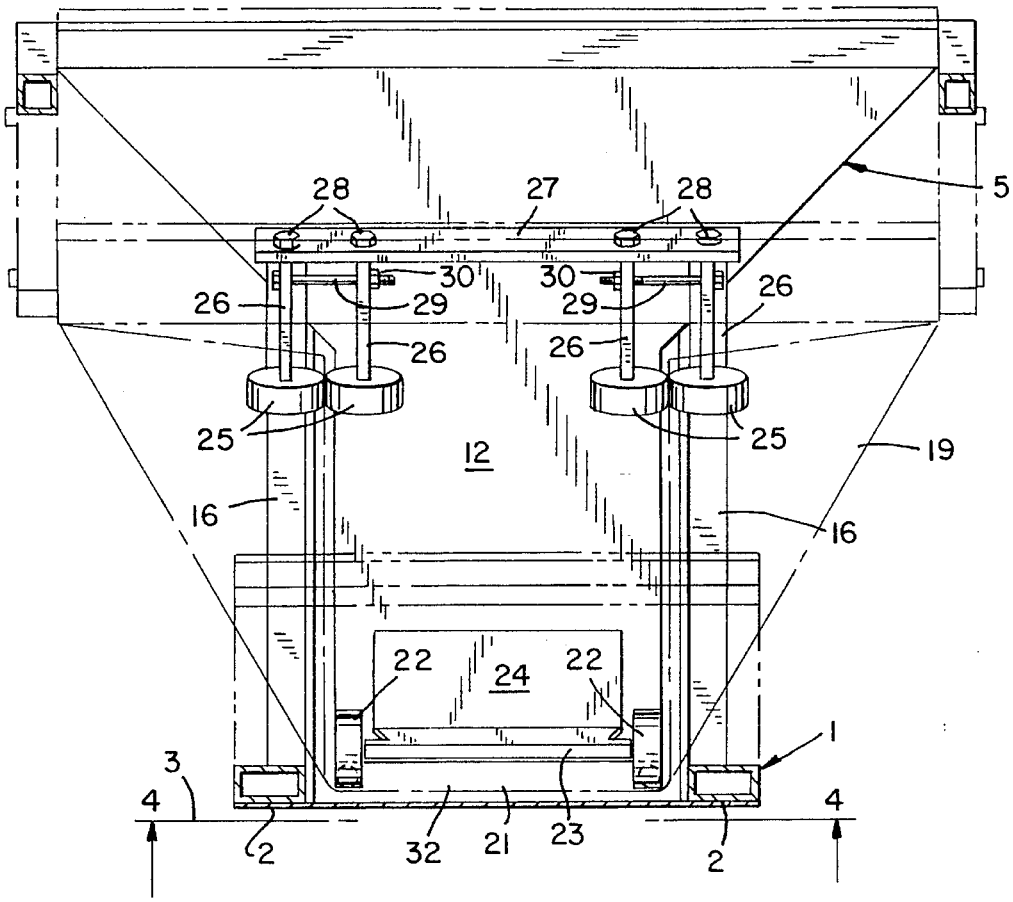
FIG. 3 is a section taken along line 3—3 of FIG. 2.

To adjust the spacing between the rollers 25 of each pair, bolts 29 extend through aligned openings in the shafts 26 of each pair of rollers, and the threaded ends of bolts 29 are engaged with nuts 30, as seen in FIG. 3. Through threaded adjustment of bolts 29, the spacing between the rollers 25 of each pair can be adjusted.

As best seen in FIG. 3, the rollers 22 ride against the bottom surface 32 of the folded sheet 21, while the upper portions of the side surfaces 33 of the folded sheet 21 travel between the respective cooperating rollers 25. As shown in FIG. 2, the axes of rollers 25 are located at an acute angle of about 10° with respect to the vertical and this angularity of the rollers serves to apply upward tension to the side surfaces 33 of the sheet, as the sheet passes through the rollers.

The folding of sheet 19 is also aided by a pair of rotatable sleeves 34 or bushings that are mounted on shafts 35 that project outwardly from the forward end of hopper 5. The sleeves 34 are located immediately to the rear of rollers 22. The sheet 19 rides against the sleeves 34 as it is folded to the U-shaped configuration.

The weight of the particulate material 6 in hopper 5 bears against the bottom surface 32 of the folded sheet 21, and will hold the sheet against the terrain 3 as the frame 1 is moved forwardly. The forward end of frame 1 carries a pull cable 36 which can be attached to a suitable driving source, such as a tractor, truck, winch, of the like. Thus, operation of the drive unit will move the frame 1 relative to the particularly filled folded sheet 21, with the folded sheet remaining in contact with the terrain 3.

As shown in FIG. 2, the lower edge 37 of each inner side wall 8 of hopper 5 is inclined upwardly in a rearward direction to prevent the particulate material from jamming between the walls 7 and 8. As previously noted, the side surfaces 33 of folded sheet 21 pass through the spaces 9 between the inner and outer side walls 7 and 8 of the hopper. Thus, the particulate material does not exert a downward force on the side surfaces 33 of the folded sheet 21 which could act to draw the side surfaces downwardly.

Figure 6:
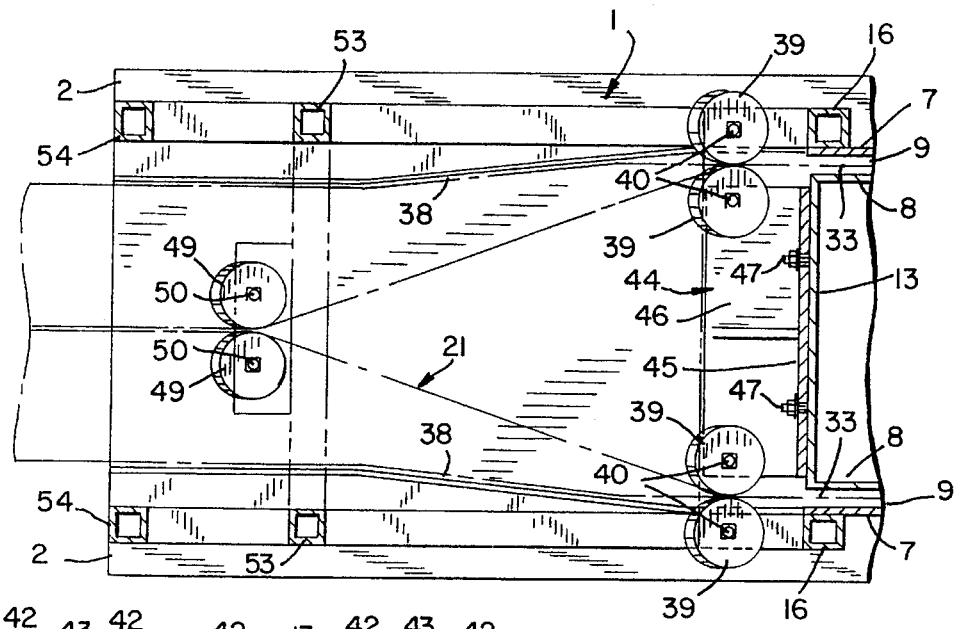
FIG. 6 is a partial top view of the apparatus.

Extending rearwardly from hopper 5 are a pair of spaced side walls 38 which are supported on runners 2, side walls 38 converge in a rearward direction, as shown in FIG. 6, and as the folded sheet 21 containing the particulate material 6 passes between side walls 38, the material 6 will be compressed laterally within the folded sheet.

Located at the rear end of hopper 5 are two pair of rollers 39. Each roller 39 is journaled on the lower end of shaft 40 and the upper ends of the shafts are supported from a plate 42 that projects rearwardly from rear wall 13 of hopper 5. The shafts are attached to the plate by engagement of nuts 43 with the upper threaded ends of shafts 40. As in the case of rollers 25, the spacing between the rollers 39 of each pair can be adjusted by means of bolts 43, which are connected between the shafts 40 of adjacent rollers.

The axes of rollers 39 are located at an acute angle to the vertical, generally about 10°, and this angularity acts to apply upward tension to the side surfaces 33 of the folded sheet 21, thus maintaining the side surfaces in a taut condition.

Mounted on the rear wall 13 of hopper 5, above the outlet 15 is a compression plate 44. Compression plate 44 includes a vertical leg 45 that is mounted flatwise to rear wall 13 and a downwardly inclined leg 46, which extends rearwardly from leg 45 at a downwardly inclined angle to the horizontal. As the folded sheet 21 containing the particulate material 6 passes beneath the inclined leg 46, the particulate material will be compressed downwardly within the folded sheet.

Figure 7:
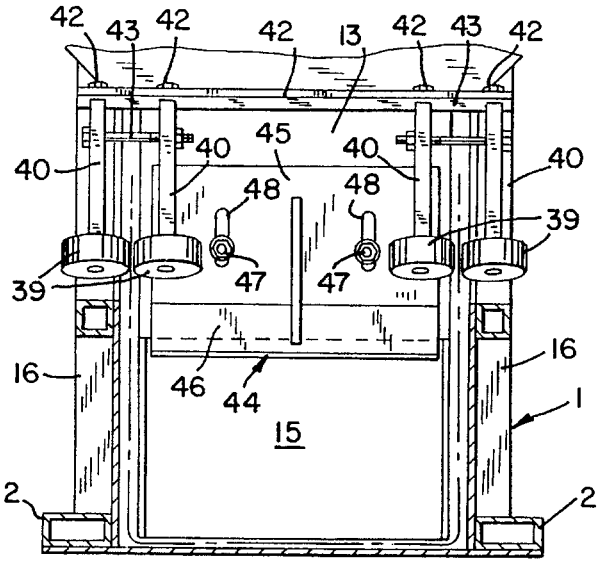
FIG. 7 is a section taken along line 7—7 of FIG. 2.
Figure 8:
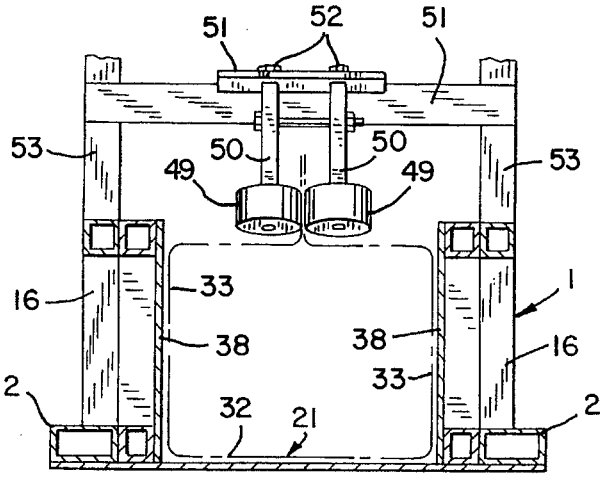
FIG. 8 is a section taken along line 8—8 of FIG. 2.

The location of compression plate 44 can be adjusted by means of bolts 47 which extend through elongated vertical slots 48 in leg 45 and are connected to rear wall 13, as seen in FIG. 7. This construction provides a vertical adjustment of compression plate 44, so that the location of the compression plate can be adjusted depending upon the configuration of the barrier being produced.

As frame 1 moves forwardly relative to the particulate filled sheet 21, the upper edges of the side surfaces 33 of the folded sheet are brought together by a pair of rollers 49. Each roller 49 is journaled on the lower end of a shaft 50, while the upper ends of shafts 50 are secured to an angle 51 by threaded engagement of a nut 52 with the upper end of each shaft. Angle 51 extends transversely across the frame, and is supported by a pair of posts 53 that extend upwardly from the side walls 38. In addition, a pair of posts 54 extend upwardly from the rear ends of side walls 38, and the upper ends of posts 54 support cover 55.

The rollers 49 act to bring the upper edges of the side surfaces 33 of folded sheet 21 into contiguous relation, as best shown in FIG. 5. The contiguous side edges can then be fastened together manually by any convenient mechanism, such as hog-ringing, stitching, or the like, to provide a closed, continuous, tubular barrier, containing the particulate material.

The continuously formed barrier can be used for flood or erosion control, or can be employed as a divider in agricultural fields. The barrier can also be employed as a traffic control medium, and in this application, signs or posts can be inserted into the barrier. When the barrier is to be used for soil or erosion control or as a traffic medium, the particulate material will generally take the form of sand, gravel, or small stones, which provide substantial weight for the barrier. It is also contemplated that the barrier can be utilized for the storage of particulate material. If the barrier is to be used for the control of oil spills on water, the particulate material can be a buoyant type, such as plastic beads, wood chips, or the like.

As previously noted, the sheet material 19 can either be porous material, which will permit the flow of water or fluids therethrough, or it can be a non-porous material, depending on the particular use of the barrier.

While the drawings illustrate a pair of runners 2 mounted on the frame and adapted to engage the terrain 4, it is contemplated that in certain situations the runners can be replaced with wheels. However, runners have the advantage that they will more readily travel over wet terrain, while wheels may sink into the wet terrain.

It is also contemplated that the filled bags can be formed in multiple, superimposed layers or tiers to provide a barrier of substantial height that can be used for flood control or as a retaining wall.

Various modes of carrying out the invention are contemplated as being within the scope of the following claims particularly pointing out and distinctly claiming the subject matter which is regarded as the invention.

I claim:

1. An apparatus for producing a continuous particulate filled bag, comprising a frame having a forward end and a rear end, terrain engaging means on the frame for riding on terrain as the frame is moved thereon, a hopper mounted on the frame and containing a particulate material, said hopper having an open bottom communicating with the terrain and having a pair of side walls and a rear wall, said hopper having an outlet in the rear wall, a sheet of flexible material mounted on the frame, folding means mounted on the frame for continuously folding said material into a generally U-shaped configuration to provide a folded sheet, said folded sheet having a bottom surface and a pair of spaced generally parallel side surfaces, said bottom surface extending across the open bottom of the hopper and disposed in contact with the terrain and said side surfaces of said folded sheet extending upwardly along the side walls of the hopper, said particulate material in the hopper being in direct contact with the bottom surface of said folded sheet, attaching means disposed at the forward end of the frame for attaching a drive mechanism to the frame to thereby move the frame relative to the folded sheet to cause the folded sheet containing the particulate material to be discharged from the hopper through said outlet, means disposed rearwardly of the hopper for moving the upper edges of the side surfaces of the folded sheet into generally proximate relation whereby said upper edges can be attached together to provide a continuously formed particulate filled bag.

2. The apparatus of claim 1, wherein the sheet is in coiled form and is located forwardly of the hopper.

3. The apparatus of claim 1, wherein each side wall of the hopper includes an inner wall section and a parallel outer wall section spaced from the inner wall section, the side surfaces of said folded sheet being disposed in the respective spaces between the inner wall section and the outer wall section.

4. The apparatus of claim 3, wherein each inner wall section has a lower edge that extends diagonally upward in a front-to-rear direction.

5. The apparatus of claim 1, and including a compression member projecting rearwardly from said hopper above said outlet, said compression member extending downwardly at an angle to the horizontal to compress the particulate material in said folded sheet as said frame is moved relative to said folded sheet.

6. The apparatus of claim 5, and including adjusting means for adjusting the vertical height of said compression member.

7. The apparatus of claim 1, and including sheet tensioning means disposed on the frame and located forwardly of the hopper for applying upward tension on each side surface of the folded sheet.

8. The apparatus of claim 7, wherein said sheet tensioning means comprises a pair of cooperating rollers to engage the upper portion of each side surface, the axis of each roller being disposed at an acute angle located forwardly of a vertical transverse plane.

9. The apparatus of claim 1, and including sheet tensioning means mounted on the frame and disposed rearwardly of the hopper for applying upward tension to the side surfaces of the folded sheet.

10. The apparatus of claim 9, wherein said sheet tensioning means comprises a pair of cooperating rollers to engage the upper portion of each side surface, the axis of each roller being disposed at an acute angle located forwardly of a vertical transverse plane.

11. The apparatus of claim 2, and including coil tensioning means for applying tension to the wound coil of material.

12. The apparatus of claim 11, wherein said coil tensioning means comprises a tension member hinged to the frame and resting on said coil.

13. The apparatus of claim 1, wherein said folding means comprises a pair of spaced lower rollers mounted on the frame and disposed forwardly of said hopper, said lower rollers being mounted for rotation on axes disposed transverse to the forward-to-rear center line of said frame, said lower rollers disposed immediately above said terrain engaging means and engaged with the bottom surface of said folded sheet, said folding means also including two pair of upper rollers, each pair of upper rollers disposed to engage a side surface of the folded sheet.

14. The apparatus of claim 13, wherein the axis of each upper roller is disposed at an acute angle located forwardly of a vertical transverse plane to thereby apply upward tension to the side surfaces of said folded sheet.

15. The apparatus of claim 13, and including a rotatable member disposed rearwardly of each lower roller and having an axis disposed parallel to said front to rear center line.

16. The apparatus of claim 1, wherein said terrain engaging means comprises a pair of spaced longitudinal runners.

17. The apparatus of claim 16, wherein each runner has an upwardly inclined forward end.

18. The apparatus of claim 1, and including a pair of side members extending rearwardly from the hopper, the space between said side members communicating with the outlet in said hopper, said side members converging inwardly in a rearward direction to compress the particulate material contained within the folded sheet.

19. An apparatus for producing a continuous particulate filled bag, comprising a frame having a forward end and a rear end, terrain engaging means on the frame for riding on terrain as the frame is moved thereon, a hopper mounted on the frame and containing a particulate material, said hopper having an open bottom communicating with the terrain, folding means for forming a sheet of flexible material into a generally U-shaped configuration to provide a folded sheet, said folded sheet having a bottom surface and a pair of spaced generally parallel side surfaces, means for locating the bottom surface across the open bottom of the hopper and in contact with the terrain, said particulate material in the hopper being in direct contact with the bottom surface of said folded sheet, means for moving the frame relative to the folded sheet to cause the folded sheet containing said particulate material to be displaced from said hopper, and means on the frame and located outwardly of the hopper for moving the upper edges of the side surfaces of the folded sheet into generally proximate relation whereby said upper edges can be attached together to provide a continuously formed particulate filled bag.

20. The apparatus of claim 19, and including means disposed in said hopper for maintaining the particulate material out of direct contact with the side surfaces of said folded sheet.

21. The apparatus of claim 19, and including sheet tensioning means located both forwardly and rearwardly of said hopper for applying upward tension to the side surfaces of the folded sheet.

22. The apparatus of claim 19, and including first compression means mounted on the frame and disposed to engage the side surfaces of the folded sheet after the folded sheet containing the particulate material is displaced from the hopper to apply lateral compression to the particulate material within said folded sheet.

23. The apparatus of claim 19, and including compression means mounted on the frame and located outside of the hopper for engaging the upper surface of the particulate material contained within the folded sheet when the folded sheet containing the particulate material is displaced from said hopper to thereby apply a downward compressive force to said particulate material.

24. An apparatus for producing a continuous particulate filled bag, comprising a frame having a forward end and a rear end, terrain engaging means on the frame for riding on terrain as the frame is moved thereon, a hopper mounted on the frame and containing a particulate material, said hopper having an open bottom directly exposed to the terrain, said hopper having a pair of side walls and a rear wall, said hopper having an outlet in a lower portion of said rear wall, each side wall including an inner wall section and an outer wall section spaced from the inner wall section to provide a clearance therebetween, folding means for forming a sheet of flexible material into a generally U-shaped configuration to provide a folded sheet, said folded sheet having a bottom surface and a pair of spaced generally parallel side surfaces, said bottom surface being disposed across the open bottom of the hopper and in contact with the terrain, and said side surfaces being disposed in the respective clearances, said particulate material in the hopper being in direct contact with the bottom surface of said folded sheet and being out of contact with the side surfaces of the folded sheet, means for moving the frame and the folded sheet relative to each other to cause the folded sheet containing said particulate material to be displaced from the outlet in said hopper, and means on the frame and located rearwardly of the hopper for moving the upper edges of the side surfaces of the folded sheet into generally proximate relation whereby said upper edges can be attached together to provide a continuously formed particulate filled bag.

25. The apparatus of claim 19, and including sheet tensioning means located both forwardly and rearwardly of said hopper for applying upward tension to the side surfaces of the folded sheet.

26. An apparatus for producing a continuous particulate filled bag, comprising a frame having a forward end and a rear end, terrain engaging means on the frame for riding on the terrain as the frame is moved thereon, a hopper mounted on the frame and containing a particulate material, said hopper having an open bottom communicating with the terrain and having a rear wall with an outlet therein, folding means mounted on the frame for continuously folding a flexible material into a generally U-shaped configuration to provide a folded sheet, said folded sheet having a bottom surface and a pair of spaced generally parallel side surfaces, said bottom surface extending across the open bottom of the hopper and said particulate material in the hopper being in direct contact with the bottom surface of the folded sheet, movement of the frame relative to the folded sheet causing the folded sheet containing the particulate material to be discharged from the hopper through said outlet, sheet tensioning means mounted on the frame and comprising a pair of cooperating rollers to engage the upper portion of each side surface of the folded sheet, the axis of each roller being disposed at an acute angle with respect to the horizontal whereby movement of the folded sheet relative to said rollers urges the side surfaces of said folded sheet upwardly to apply tension to said folded sheet, and means disposed rearwardly of the hopper for moving the upper edges of the side surfaces of the folded sheet into generally proximate relation whereby said upper edges can be attached together to provide a continuously formed particulate bag.

27. The apparatus of claim 26, wherein said apparatus includes two pair of cooperating rollers, one of said pairs being located forwardly of the hopper and a second of said pairs being located rearwardly of said hopper.

28. An apparatus for producing a continuous particulate filled bag, comprising a frame having a forward end and a rear end, terrain engaging means on the frame for riding on the terrain as the frame is moved thereon, a hopper mounted on the frame and containing a particulate material, said hopper having an open bottom communicating with the terrain and having a rear wall with an outlet therein, folding means mounted on the frame for continuously folding a flexible material into a generally U-shaped configuration to provide a folded sheet, said folded sheet having a bottom surface and a pair of spaced generally parallel side surfaces, said bottom surface extending across the open bottom of the hopper and said particulate material in the hopper being in direct contact with the bottom surface of the folded sheet, movement of the frame relative to the folded sheet causing the folded sheet containing the particulate material to be discharged from the hopper through said outlet, said folding means comprising a pair of spaced lower rollers mounted on the frame and disposed forwardly of said hopper, said lower rollers being mounted for rotation on axes disposed transverse to the forward-to-rear center line of the frame, said lower rollers disposed immediately above said terrain engaging means and engaged with the bottom surface of said folded sheet, said folding means also including two pair of upper rollers, each pair of upper rollers disposed to engage a side surface of the folded sheet, and means disposed rearwardly of the hopper for moving the upper edges of the side surfaces of the folded sheet into generally proximate relation whereby said upper edges can be attached together to form a continuously formed particulate filled bag.

29. The apparatus of claim 28, wherein the axis of each upper roller is disposed at an acute angle to the horizontal and arranged to apply upward tension to the side surfaces of the folded sheet.

30. An apparatus for producing a continuous particulate filled bag, comprising a frame having a forward end and a rear end, terrain engaging means on the frame for riding on the terrain as the frame is moved thereon, a hopper mounted on the frame and containing a particulate material, said hopper having an open bottom communicating with the terrain and having a rear wall with an outlet therein, folding means mounted on the frame for continuously folding a flexible material into a generally U-shaped configuration to provide a folded sheet, said folded sheet having a bottom surface and a pair of spaced generally parallel side surfaces, said bottom surface extending across the open bottom of the hopper and said particulate material in the hopper being in direct contact with the bottom surface of the folded sheet, movement of the frame relative to the folded sheet causing the folded sheet containing the particulate material to be discharged from the hopper through said outlet, a downwardly and rearwardly extending compression member located above said outlet for compressing the particulate material downwardly in the folded sheet as the folded sheet exits the hopper, and a pair of side members extending rearwardly from the hopper, the space between said side members communicating with the outlet in said hopper, said side members converging inwardly in a rearward direction to compress the particulate material laterally within the folded sheet.

* * * * *